US006694551B1

(12) United States Patent
Garrido

(10) Patent No.: US 6,694,551 B1
(45) Date of Patent: Feb. 24, 2004

(54) FACIAL SUPPORT DEVICE

(75) Inventor: Alfonso R. Garrido, Greensboro, NC (US)

(73) Assignee: Alpa, Inc., Greensboro, NC (US)

( * ) Notice: Subject to any disclaimer, the term of this patent is extended or adjusted under 35 U.S.C. 154(b) by 0 days.

(21) Appl. No.: 10/331,355

(22) Filed: Dec. 30, 2002

(51) Int. Cl.[7] ..... A47C 20/00
(52) U.S. Cl. ..... 5/638; 5/643; 5/656
(58) Field of Search ..... 5/648, 656, 638, 5/643, 725

(56) References Cited

U.S. PATENT DOCUMENTS 2,551,727 A * 5/1951 Costello ..... 5/638
2,634,435 A * 4/1953 Budd ..... 132/333
3,114,527 A * 12/1963 Demarest ..... 248/118
3,388,407 A * 6/1968 Harris ..... 5/638
5,829,080 A * 11/1998 Robillard et al. ..... 5/638
6,151,734 A * 11/2000 Lawrie ..... 5/640
6,221,036 B1 * 4/2001 Lucas ..... 602/23
6,581,226 B1 * 6/2003 Brustein ..... 5/643

* cited by examiner

*Primary Examiner*—Michael F. Trettel
(74) *Attorney, Agent, or Firm*—John H. Faro, Esq.

(57) ABSTRACT

A facial support device having a frame and a cushion, or webbing, for supporting an individual's head, when the individual is reclining in a prone, face down position. The device of this invention is ergonomically designed to provide a gradual transition from the plane of an individual's reclining torso to his head, and thereby avoid or minimize stresses to the cervical spine, and to the musculature of the neck and back. This device includes an asymmetric opening associated with its cushion or webbing to permit unrestricted breathing by an individual when reclining in a face down position.

5 Claims, 3 Drawing Sheets

FACIAL SUPPORT DEVICE

BACKGROUND OF THE INVENTION

1. Field of the Invention

This invention relates to an article of manufacture. More specifically, this invention is directed to a device suitable for use in both recreational and commercial environments to support an individual's face, without restriction of vision or breathing, when the individual is in a prone, face down reclining position.

2. Background of Invention

Recliners or chaise loungers have traditional been constructed of multiple discrete sections to support different areas of the human body. More specifically, such recliner or loungers generally have a discrete section or area designed to support the legs, another section for the low back and yet another section for the neck or head. In each instance, these sections are biased, in terms or design and construction, to accommodate a unique area of the human physique, either through physical shape or resistance/support or a combination of the two. In a number of instance such recliners and loungers have been adapted to accommodate an individual in a face down reclining position. Such face down recliners are commonly found in chiropractic offices or in salons that provide message therapy; and, to a lesser degree in beach and patio furniture.

The following patent are representative of the types of recliners and loungers that have been adapted for support of an individual in a prone, face down reclining position.

U.S. Pat. No. 5,237,713 (to Prager, issued Aug. 24, 1993) discloses a lounge cushion having discrete areas, wherein each area is specific for proper cervical, lumbar and leg support of individual, when lying on one's back. Additionally, the Prager design incorporates an orifice in the back section of the cushion, which he characterizes as a "prone-face opening" This prone-face opening permits an individual to lie on his stomach without turning his head to one side or the other, thereby eliminating possible stress to the cervical spine, or to the musculature associated with the neck. The Prager design requires a frame for support of the cushion, and means for adjustment of the support bolsters associated with the cushion, to tailor the fit of the cushion to different body structures and dimensions.

U.S. Pat. No. 6,128,797 (to Shaffer, issued Oct. 10, 2000) discloses a body support cushion or pad for face down tanning, or a massage. The Shaffer support cushion is made from any suitable material that is firm enough to support a person's body, yet soft enough to be comfortable for a person's face. In a preferred embodiment, the Shaffer support cushion is composed of foam rubber so as to enhance the softness of the cushion. The cushion has an elongated recess for accommodating a person's face. Ventilation apertures extend from each side of the pad, and are in fluid communication with the elongated facial recess, to provide air circulation. The cushion provides a proper postural position when a person is lying in a prone position.

The Shaffer patent also discusses a number of similar configurations for facial support, including the U.S. Pat. Nos. 2,959,794; 3,266,794; 3,747,916; 3,897,102; 4,207,635; 4,723,329; 4,941,222; 5,237,713; 5,222,779; European Pat. 69,079; GB Patent 1,391,506; & Fr. Patent 2,431,271. In brief, all such prior art generally comprises a frame, and flexible material or webbing, to support an individual. Where face down reclining is contemplated, the material or webbing includes a hole or orifice to provide facial support for an individual while reclining in the face down position. The Shaffer cushion is presumable a variant of the foregoing designs and is limited in its support to an upper body cushion.

As is evident from the foregoing discussion, the prior art devices can provide full body support or simply upper body support. In each instance, the objective is the same—relief of stress on the cervical spine while face down reclining. The means adopted to achieve this common object suffer from a number of deficiencies. For example, the full body support lounge is cumbersome, and even when "folded" is difficult to carry and store. Moreover, the elaboration of such cushion with a number of support bolsters, requires manipulation thereof to tailor the support for individual body shape and size. In the case of the Prager design, the neck bolster (ref. no 42) cannot be removed. Accordingly, it may cause discomfort when the individual lies on his stomach in a face down prone position. The facial support cushion of Shaffer is considerable more convenient, and easier to handle, however, is too confining and unacceptable for social/eye contact or reading. Thus, there continues to exist a need to improve such face down recliners, specifically, to preserve the desirable features of each and yet reduce or eliminate their complexity and limitations.

OBJECTS OF THE INVENTION

It is the object of this invention to remedy the above as well as related deficiencies in the prior art.

More specifically, it is the principle object of this invention to provide a facial support device having the versatility of a lounger or chaise, and yet the convenience and simplicity of pillow or cushion.

It is another object of this invention to provide a facial support device that provides unobstructed vision and breathing in use.

Additional objects of this invention a method for support of an individual's head, when lying in a face down prone position, without stress of the cervical spine or the neck musculature associated with the neck and/or the movement of the head.

SUMMARY OF THE INVENTION

The above and related objects are achieved by providing a facial support device consisting essentially of a frame, a support panel and an asymmetrical oval orifice centrally located within said support panel. The frame of this device can comprises a unitary or composite structure defining at least three distinct sections arranged in three distinct planes: a distal section, a medial section and a forward section. The distal section and forward section of the frame are located on either end of the device and opposite to one another; and, are inclined from the horizontal plane, and in opposite directions to one another, so as to elevate the medial section thereof above the level of the plane supporting the individual's torso. In the preferred embodiments of this invention, the distal section is shorter than the forward section, so as to provide the device with a rise or incline from the rear, or distal end, to forward end thereof. The degree of incline is dictated by both comfort, and intended to provide a relatively mild transition from the plane supporting the individual's torso, to the plane of medial section of the frame of the device, which is designed to support the head.

The medial section of the frame of the device is provided with a resilient padded panel that is affixed, along its lateral borders, to the lateral sides of the medial section of the frame, and to at least the lateral sides of the forward section of the frame. This resilient padded panel is further provided with an asymmetric oval opening, or orifice, located in essentially the middle of the panel. The size and dimension of this opening provides both a chin and forehead support for an individuals head, in the face down prone position, while allowing for essentially unobstructed forward vision and free breathing through this opening. The elevation of the face from the plane of the torso is sufficient to permit placement of a book or other visual materials under the panel, and, thus, avoids isolation of the individual's face from the ambient environment.

The facial support device of this invention can be used in a recreational and home environment, or in a clinical setting, where an individual lies in face down prone position.

DESCRIPTION OF THE INVENTION INCLUDING PREFERRED EMBODIMENTS

The Figures which accompany this application, and referenced herein, depict representative facial support devices of this invention. In the embodiments of this invention illustrated in these Figures, the components of the device have been isolated to from one another, where practical, to depict their individual features and interactions with one another.

Figure 1:
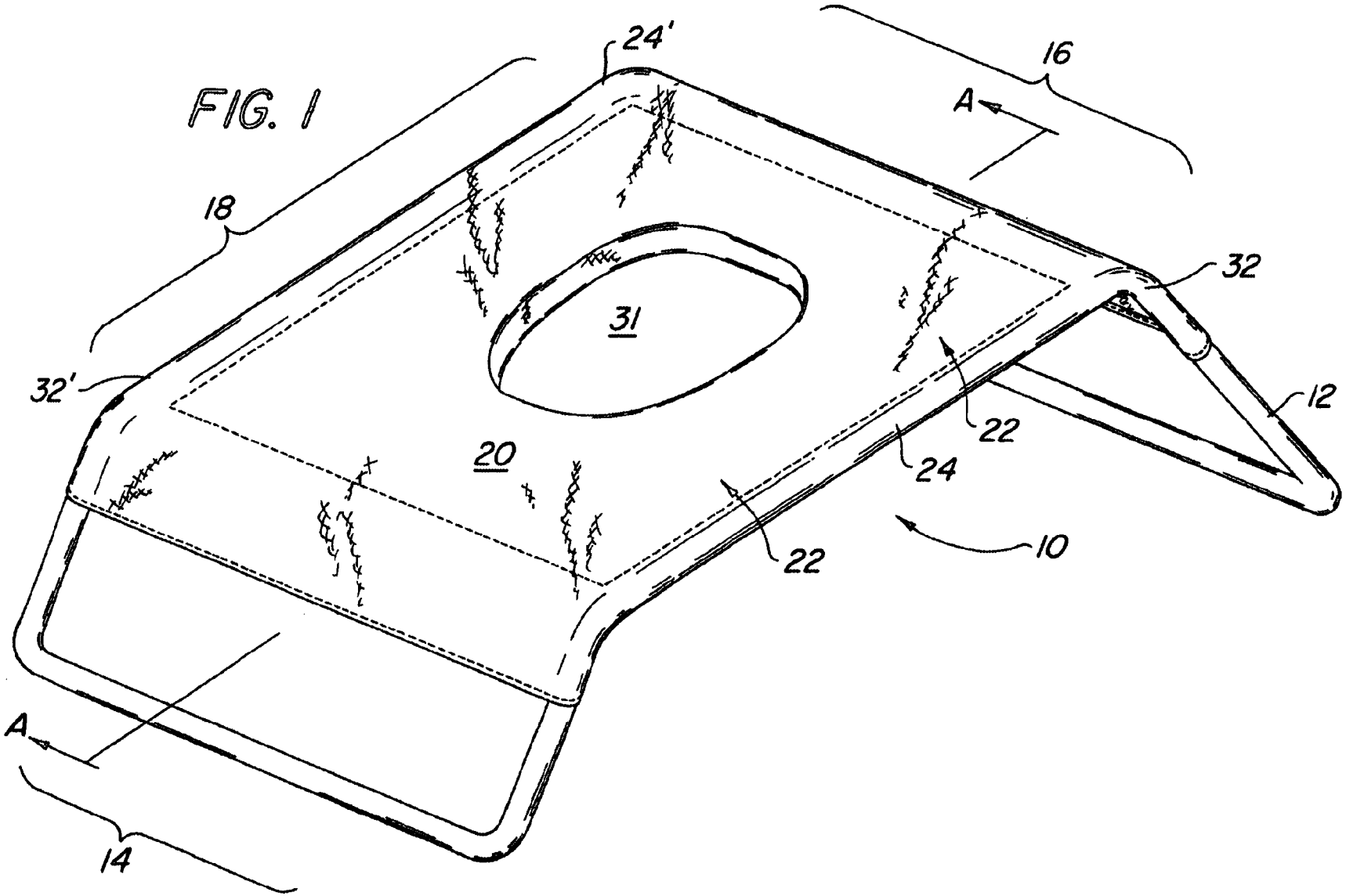
FIG. 1 is perspective view of the preferred embodiment of the facial support device of this invention.
Figure 2:
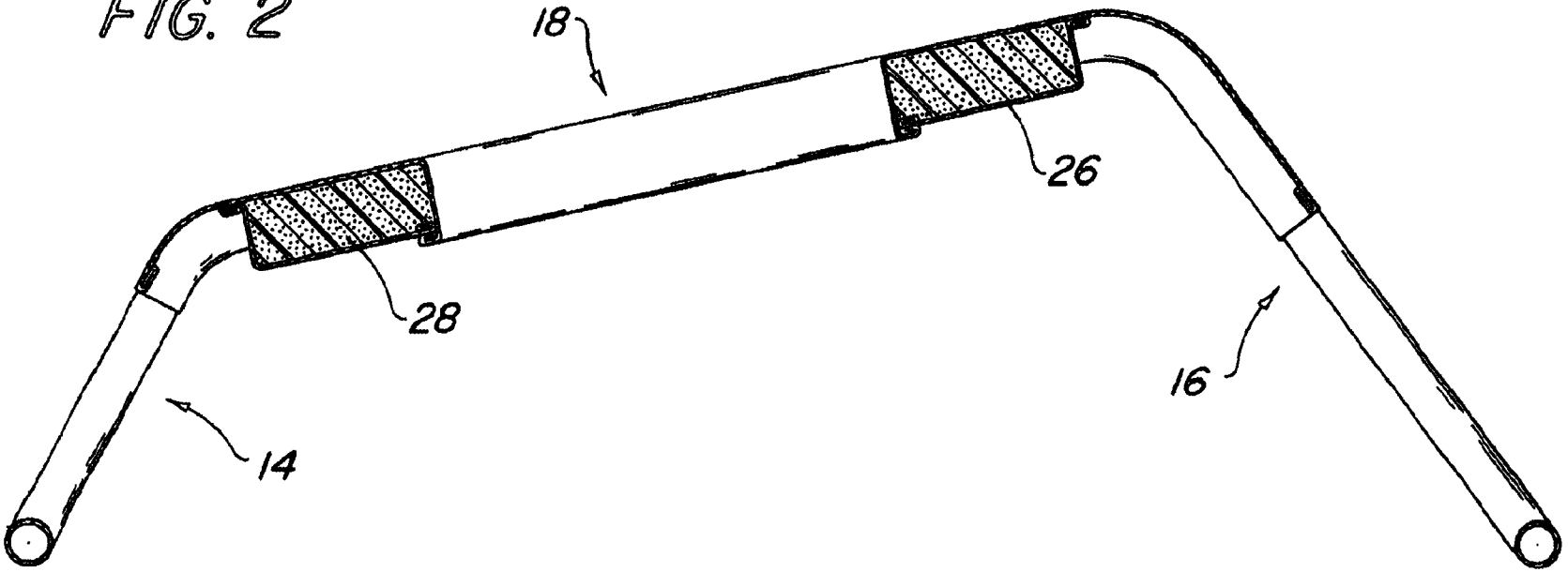
FIG. 2 is a side view, in cross-section, through the device of FIG. 1 at AA.
Figure 3:
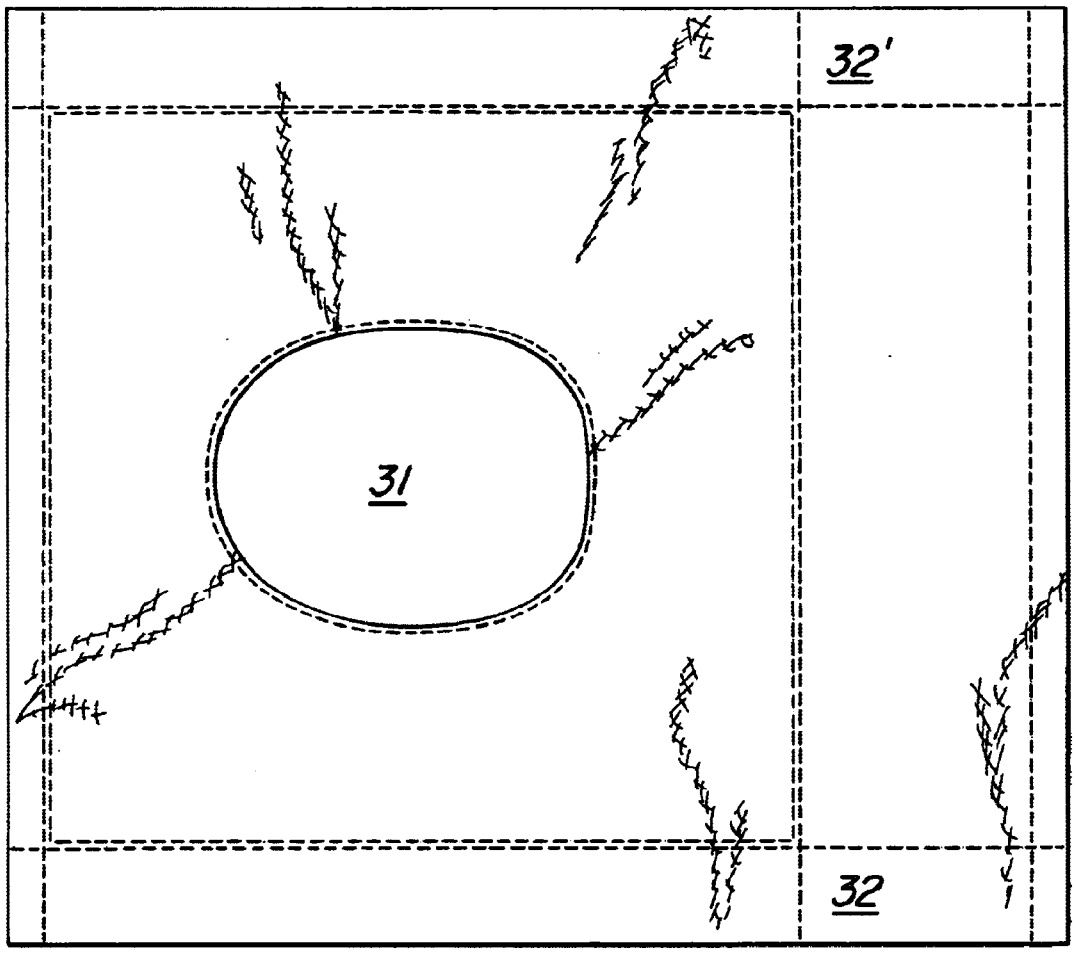
FIG. 3 is a top view of the resilient pad panel of the device shown in FIG. 1.

FIG. 1 shows the facial support device (10) of this invention in perspective, including the relative proportions of each discrete section thereof. The frame (12) of the device (10) is an essentially continuous form, and can be constructed in sections, or manufactured as single piece. In the preferred embodiments of this invention, each of the distal section (14) and forward section (16) of the frame (12) is each inclined from the horizontal, and in opposite directions to the other. The relative proportions of each of these sections (14, 16) on each end of the device, is designed to provide a back to front incline in the medial section (18) of the frame, and thus provide both comfort and facial support on a resilient, padded panel (20), without stress to the cervical spine.

This resilient, padded panel (20) comprise a defined support area (22) a border area (24). The central area (22) of the panel (20) includes pocket or enclosure (26) for a foam insert (28), and a channel (32, 32') along said border (24) for attachment to the frame (12). This pocket enclosure (26) is created at the time of manufacture and assembly of the panel (20), and provides a captive environment for the foam insert (28). This panel (20) includes an asymmetrical opening or cut-out (31) that permits unobstructed vision and breathing when supporting an individual's head in the face down prone position. The material from which the resilient, padded panel (20) is fabricated is dimensionally stable under load, and, thus, is resistant to distortion by the pressure exerted thereon by the weight of an individual's head.

The resilient, padded panel (20) is affixed to, and supported by, the frame through the provision of a pair of opposing channels (32, 32') which are formed along the lateral borders (24, 24') of the panel (20). These channels (32, 32') can be permanently sewn into the panel (20), or means for attachment (not shown) provided on each such border (24, 24') to releasably secure the panel (20) in-place on the frame (12), and later permit removal thereof for cleaning or replacement.

The border portion (24, 24') of the resilient, padded panel (20) is preferably oversized so as to extend beyond the medial section (18) of the frame, and overlap each of the distal portion (14) and forward portion (16) of the frame, and to prevent the padded panel (20) thereof from movement on the frame (12). The amount of overlap is preferably proportioned relative to length of each of the distal and forward sections of the frame, and sufficient to prevent linear movement of the padded panel on the frame.

The basic design of the facial support devices of this invention can be enhanced by modification of its existing configuration or by addition of accessories to its existing configuration. For example, the resilient padded panel can include one or more accessory pockets for a beverage container, sun glasses or cellular phone. In addition, the frame can be adapted to support a canopy, or an umbrella, to provide shade from the sun. Other modification and enhancements to the facial support devices, consistent with its intended usage, are obvious and within the contemplation and spirit of this invention. The foregoing is intended as simply illustrative of a number of preferred embodiments of this invention, and not otherwise intended as delineating its scope, which is set forth in the claims that follow.

What is claimed is:

1. In a facial support device having a frame and a cushion, or webbing, associated with said frame, for supporting an individual's head, when said individual is reclining in a prone, face down position, said device having an opening associated with said cushion or webbing to permit unrestricted breathing by said individual when reclining in the face down position, wherein the improvement comprises:

A. a frame consisting essentially of a continuous element having a unitary or composite structure, said frame having at least three functionally distinct sections arranged in three distinct planes, including a distal section, a medial section and a forward section, said distal section and said forward section on either end of the device being inclined from the horizontal plane, and in opposite directions relative to one another, so as to elevate said medial section thereof and thereby provide face down support for a head of a reclining individual, at a level above said individual's reclining torso; and B. a resilient, head support panel associated with and supported by said medial section of the frame along its lateral borders, said support panel including means for supporting a chin and forehead of said a face down reclining individual, and an asymmetric oval opening, or orifice, between said chin and said forehead support sufficient to permit unobstructed vision and free breathing through said opening in said panel.

2. The facial support device of claim 1, wherein said frame includes means for opening said frame to permit installation and removal of said resilient, head support panel.

3. The facial support device of claim 1, wherein said distal section of said frame is shorter than the forward section, so as to provide said panel of said device with a rise or incline from said distal end, to said forward end thereof, wherein said rise or incline in said panel is sufficient to provide a comfortable, stress free transition from said reclining individual's torso, to said support panel of said device.

4. The facial support device of claim 1, wherein said panel includes a chamber or a pocket and a foam insert captive within said chamber or pocket, said foam insert being essentially coextensive with at least said chin and forehead supports of said panel.

5. The facial support device of claim 1, wherein said panel includes a pair of pockets along each of its lateral borders for physical attachment of said panel to said frame.

* * * * *